US005946014A

United States Patent [19]

Shimomura et al.

[11] Patent Number: 5,946,014

[45] Date of Patent: Aug. 31, 1999

[54] INK TANK CARTRIDGE AND INK-FILLING DEVICE THEREFOR

[75] Inventors: Akihiko Shimomura, Yokohama; Hajime Kishida; Makoto Shioya, both of Tokyo; Osamu Sato, Kawasaki; Shoji Shiba, Sagamihara; Yoichi Taneya, Yokohama; Mariko Suzuki, Kawasaki, all of Japan

[73] Assignee: Canon Kabushiki Kaisha, Tokyo, Japan

[21] Appl. No.: 08/446,242

[22] Filed: May 22, 1995

[30] Foreign Application Priority Data

May 23, 1994 [JP] Japan ..... 6-108141
May 17, 1995 [JP] Japan ..... 7-118489

[51] Int. Cl.[6] ..... B41J 2/175

[52] U.S. Cl. ..... 347/87; 141/2; 141/18

[58] Field of Search ..... 347/85, 86, 87; 141/2, 18, 364, 369, 51, 53, 55, 326

[56] References Cited

U.S. PATENT DOCUMENTS

| | | | |
|---|---|---|---|
| 761,702 | 6/1904 | Paradis | 141/55 |
| 4,183,031 | 1/1980 | Kyser et al. | 346/140 R |
| 4,419,677 | 12/1983 | Kasugayama | 347/87 |
| 4,591,875 | 5/1986 | McCann | 347/86 |
| 4,700,202 | 10/1987 | Kuranishi et al. | 347/86 |
| 4,723,129 | 2/1988 | Endo et al. | 347/56 |
| 4,740,796 | 4/1988 | Endo et al. | 347/56 |
| 5,182,579 | 1/1993 | Haruta et al. | 347/87 |
| 5,187,498 | 2/1993 | Burger | 346/140 R |
| 5,220,949 | 6/1993 | Rufenacht | 141/2 |
| 5,280,300 | 1/1994 | Fong et al. | 347/87 |
| 5,381,172 | 1/1995 | Ujita et al. | 347/86 |

FOREIGN PATENT DOCUMENTS

| | | | |
|---|---|---|---|
| 0579492 | 1/1994 | European Pat. Off. . | |
| 0640484 | 3/1995 | European Pat. Off. . | |
| 2440884 | 6/1980 | France . | |
| 187361 | 11/1983 | Japan | 347/86 |
| 61-284445 | 12/1986 | Japan . | |
| 180351 | 7/1989 | Japan | 347/86 |
| WO92/20577 | 11/1992 | WIPO . | |

*Primary Examiner*—Valerie Lund
*Attorney, Agent, or Firm*—Fitzpatrick, Cella, Harper & Scinto

[57] ABSTRACT

An ink tank cartridge having ink-storing part for storing ink to be supplied to a recording head which ejects ink in droplets and being mountable to and demountable from a recording apparatus, the ink tank cartridge comprises a main body of a container constituting the ink-storing part; an ink-absorbent held in the main body of the container for storing the ink; an ink-supplying part for supplying the ink to the recording head; and an air communication part to communicate the interior of the main body of the container with the air, the air communication part having a large-diameter opening capable of opening the interior of the main body of the container to the outside and being provided with a plug member having a fine opening attachably to and detachably from the large-diameter opening.

4 Claims, 2 Drawing Sheets

INK TANK CARTRIDGE AND INK-FILLING DEVICE THEREFOR

BACKGROUND OF THE INVENTION

Field of the Invention

The present invention relates to an ink tank cartridge which stores ink to be supplied to a recording head and is mountable to and demountable from a recording apparatus, and to an ink filling device for filling an ink to the tank. More particularly, the present invention relates to an ink tank cartridge which has a plug member having a fine opening and being detachable from the air hole of the ink tank cartridge to facilitate the ink filling operation, and also relates to an ink filling device which has an fitting member to fit the air hole of the ink tank cartridge.

In the field of application of ink-jet recording, the ink cartridges are increasingly used which have a recording head and an ink tank exchangeable separately or integrally in view of more reliable ink feeding, easier handling of the recording head and the ink tank, and higher maintainability thereof. The ink cartridge is generally constituted to be mountable to and demountable to a carriage scanning a recording area.

The exchangeable ink tank cartridge or the cartridge which is constructed integrally with a recording head and an ink tank is exchanged with a new one when the ink therein has been exhausted. The old cartridge is usually thrown away as waste. With the increased interest on the global environment, reuse of the empty cartridge by refilling of ink thereto is attracting attention.

Conventional ink tanks are not constructed to be refilled. Therefore, an ink refill kit is proposed which drills a hole on the ink tank wall at a prescribed position, and refills ink through the drilled hole by a thin tube like a syringe needle. The refilling of ink by inserting a thin tube into a hole should be carefully conducted so as to inject the ink at a rate lower than the ink penetration rate into the ink-absorbing material in the ink tank to avoid overflow of the ink from the hole. When a hole is drilled, formed shavings may enter the interior of the ink tank, which may adversely affect the feed of the refilled ink. The drilled hole has to be sealed after the ink refilling to prevent leakage of the ink.

The ink refill kit after ink refilling would cause environmental pollution, if it is thrown away. This problem can be solved by constructing the ink refill kit from a biodegradable plastics which is decomposable in the natural environment with lapse of time. Biodegradable plastic materials, however, are generally not completely resistant to ink. The biodegradable material which is suitable as a constructing material of the ink refill kit, if it could be selected, would be extremely expensive to raise the cost of the refill kit.

The present invention has been made after comprehensive studies to solve the above problems.

SUMMARY OF THE INVENTION

The present invention intends to provide an ink tank cartridge which can simply be refilled with ink without drilling and without occuring shavings a refilling hole on the cartridge wall, which can be achieved by constructing the air hole of the ink cartridge from a large-diameter hole and a detachable plug having a fine air communication hole provided detachably at the large-diameter hole, and refilling ink from the large-diameter hole by removing the plug by use of a ink-filling device.

The present invention also intends to provide an ink-filling device which has a fitting member to be fitted to a large-diameter hole of an ink tank along a hollow tube for injecting ink into an ink tank, enabling filling of ink with the hole closed without leakage of the ink from the hole.

The present invention further intends to provide an ink tank cartridge having an ink-storing part for storing ink to be fed to a recording head which ejects ink as droplets and is mountable to and demountable from the recording apparatus; the ink tank cartridge comprising a container for the ink storing parts, an ink-absorbent for storing the ink, an ink-feeding part for feeding the ink to the recording head, and an air-communicating part which has a large-diameter hole for opening the interior of the container to the exterior and a plug having a fine hole detachable from the large-diameter hole.

The present invention still further intends to provide an ink-filling device for refilling ink to be fed to a recording head into an ink tank through an ink injection hole, which comprises an ink-storing part for storing ink for refilling, compression mechanism for compressing the storing part, a hollow tube connected to the storing part, and a fitting member placed on the hollow tube; the fitting member fits an ink injection hole and has,an air hole communicating the interior of the ink tank to the exterior in a fitted state to the ink tank.

DESCRIPTION OF THE PREFERRED EMBODIMENTS

Figure 1:
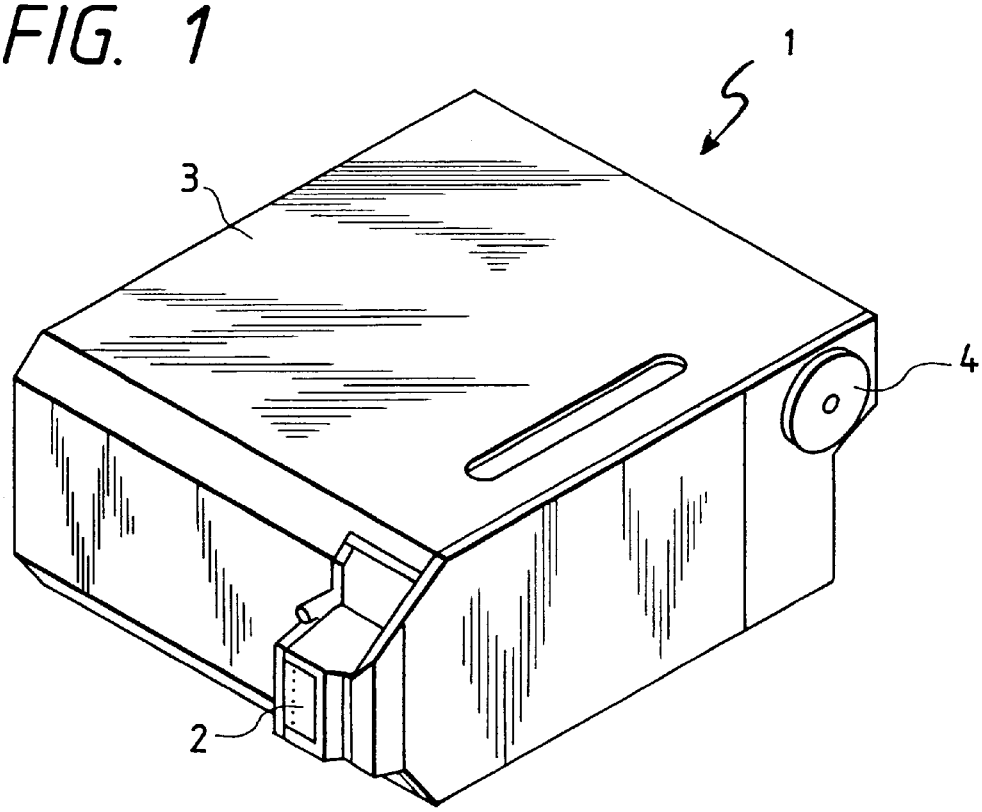
FIG. 1 is a perspective view of an example of an ink-jet cartridge provided with an ink tank cartridge according to the present invention.

The ink-filling device of the present invention is preferably constructed from a biodegradable material, and the ink-contacting face of the device is preferably worked for ink-resistance. This working for the ink-resistance broadens the scope of selection of the applicable biodegradable material and makes easier the selection of the biodegradable material for the device. Thereby, even a biodegradable material having less ink-resistance can be employed for the device to lower the material cost and the product price.

The biodegradable materials are resins described below. The biodegradable resins herein mean the resins which has similar properties as conventional synthetic plastics under usual application conditions, and comes to be degraded in the presence of soil microorganism under waste disposal environmental conditions, for instance land-filling.

The biodegradable resins are classified into three types: (1) natural polymers, (2) fermentation-produced polymers, and (3) chemical synthetic polymers.

The natural polymers include benzylated wood (produced from cellulose or lignin by treatment with alkali like sodium hydroxide and subsequent reaction with a chemical substance having a benzyl group and an acetyl group); higher fatty acid-esterified wood; wheat gluten modified by addition of glycerin, glycol, emulsified silicone oil, and urea;

cellulose added chitosan (Government Industrial Research Institute, Shikoku); Mater-Bi (trade name, composed of starch and modified PVA, Novamont/Nippon Synthetic Chemical Co., Ltd.); Novon (trade name, starch added an additive, Warner Lambert Co.); pullulan, alginic acid, chitin, chitosan, carrageenan, and starch.

The fermentation-produced polymers include linear polyesters of 3-hydroxybutyric acid (HB) with 3-hydroxyvaleric acid (HV) (Biopol, trade name, produced by fermentation of sugar by hydrogen bacteria, the molecule itself being biodegradable, Zeneca K.K.); linear polyesters of 3-hydroxybutyric acid (HB) with 4-hydroxybutyric acid (HB) (Institute for Resources, Tokyo Institute of Chemical Technology); polyhydroxyalkanoate (PHA, generic name of polyesters produced by microorganisms); Cardran (trade name, a polysaccharide composed of β-1,3-glucan, Takeda Chemical Industries, Ltd.); and bacterial cellulose (derived by microorganism, Ajinomoto Co., Ltd.).

The chemical synthetic polymers include Placcel and Tone (trade names, composed of polycaprolactone, Daicel Chemical Industries, and UCC.); Resomer composed of polylactic acid/polyglycolide (trade name, DuPont Mitsui/Kyowa Hakko Kogyo Co., Ltd.); Lacty (trade name, composed of polylactic acid, Shimadzu Corporation); polyglutamic acid (composed of poly-γ-methylglutamate, Ajinomoto Co., Ltd.); Bionole (trade name, composed of an aliphatic polyester, Showa Highpolymer Co., Ltd.); polyesterpolyethers; ethylene-vinyl alcohol copolymers; polyesters; polyethers; copolymers of polyurethanes and aliphatic polyamides; copolymers of aromatic polyesters and aliphatic polyesters; and polyamides.

The above resins are decomposed entirely biologically by a microorganism, finally into carbon dioxide and water.

The above biodegradable resins still involve problems in ink resistance. To solve the problems, an ink-resistant layer is provided on a necessary portions. More specifically, the ink container is made of a biodegradable plastics, and an ink-resistant layer is provided on an ink-contacting face. The preferred plastic materials are completely biodegradable plastics, in view of decomposability in environment, non-electrochargeableness, and gas barrier properties. The preferred plastic materials include fermentation-produced polymers such as Biopol (trade name, ICI, Ltd.) and bacteria cellulose; natural polymers such as a mixture of chitosan and cellulose; mixtures of a natural polymer and modified polyvinyl alcohol such as Mater-Bi (trade name, Novamont Co.); and chemically synthesized aliphatic polyesters such as Bionole (trade name, Showa Highpolymer Co., Ltd.).

The plastic may be a biologically disintegrable resin composed of a synthetic plastics and a biodegradable material dispersed therein. A biodegradable material highly suitable therefor is a master batch of modified corn starch such as Ecostar (trade name, Centlaurence Starch Co.). The biodegradable material is incorporated into the synthetic plastics at a content of 10% or more by weight. The synthetic plastics for the base material is preferably linear low density polyethylene, and high density polyethylene, which are decomposed at a high rate.

The working for ink resistance is explained below. The ink tank constructed from the biodegradable material is not always satisfactory in resistance to ink as described above. To improve the reliability of the ink tank, an ink-resistant layer made of an ink-resistant material may be provided on a necessary portion of the ink tank.

The material for the ink-resistant layer may be either an organic material or an inorganic material.

The organic material includes synthetic plastics such as polyethylene terephthalate, polypropylene, polyacrylonitrile, MXD 6-nylon, and polyethylene which have high ink-resistance and satisfactory gas barrier properties. Halogen-containing synthetic plastics are not suitable for the present invention in view of environmental pollution. The ink-resistant layer is provided to protect the biodegradable plastic from the ink, and is formed in a practicably smallest thickness for the employed material, preferably not more than 100 μm.

As the inorganic material for the ink-resistant layer, $SiO_x$ is the most suitable in view of ink resistance, gas barrier properties, and influence on the environment. $SiN_y$ and alumina are also suitable therefor. The coating with $SiO_x$, or $SiN_y$. may be conducted by PVD such as sputtering, vacuum vapor deposition, and ion plating, but the most suitable coating method is low temperature plasma CVD in view of the adhesiveness of the layer to the resin. In particular, $SiO_x$ film can be formed by CVD by supplying gaseous monosilane ($SiH_4$) onto the surface of the resin at a temperature of not higher than 100° C. with high transparency, high hardness, and sufficient density. The reaction temperature of not higher than 100° C. is highly favorable for working of the biodegradable plastics. The layer of $SiO_x$ or $SiN_y$. is formed preferably in a thickness of from 4 to 7 μm, and the layer of alumina, from 60 to 150 nm because of mechanical strength of the formed layer.

The above-described ink-resistant layer, which is formed in a very small weight or volume in comparison with the biodegradable plastics of the main material, does not impair the properties of the plastics, and causes little environmental pollution in incineration and land-filling. When the ink-resistant layer is organic, the material should be selected to be suitable for the kind of the ink: aqueous dye inks, aqueous pigment inks, non-aqueous dye inks, and nonaqueous pigment ink.

The constitution of examples of the present invention is described in detail by reference to the drawings.

Figure 2:
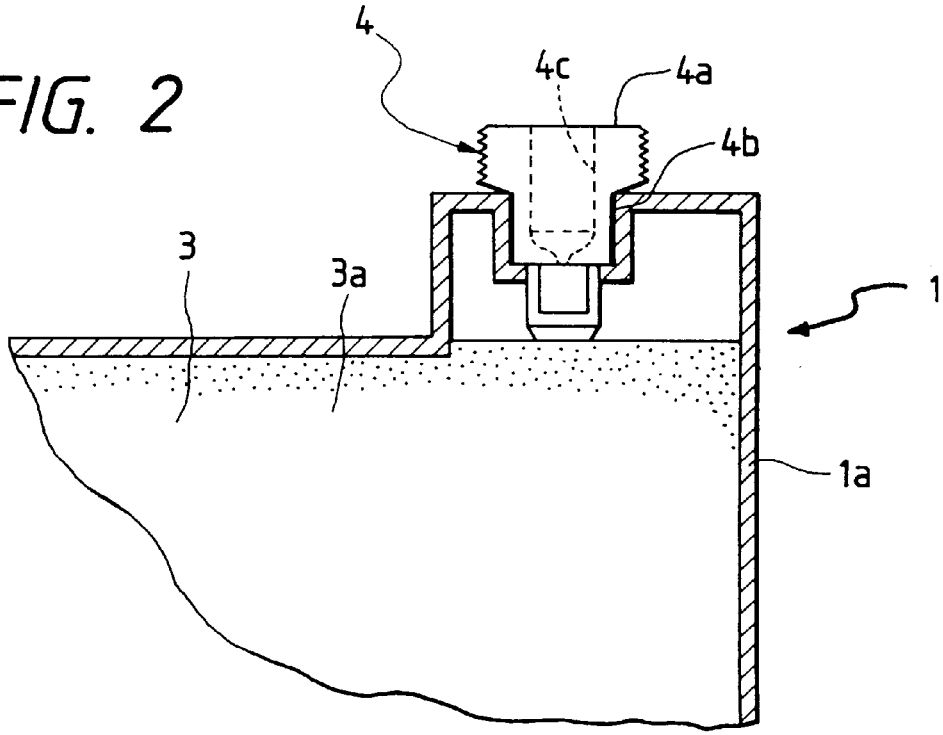
FIG. 2 is a partial enlarged sectional view of the cross-section of a construction of an air hole portion of the ink-jet cartridge.

FIG. 1 is a rough perspective view of an example of an ink-jet cartridge constituted integrally from an ink tank cartridge (hereinafter simply referred to as an "ink tank") and a recording head to which ink is supplied. FIG. 2 is a partial enlarged sectional view of a construction of an air hole portion of the ink-jet cartridge.

The ink-jet cartridge 1 shown in FIG. 1 comprising a recording head 2 and an ink tank 3 is constructed to be mountable to and demountable from a carriage (not shown in the drawing) of a recording apparatus. The recording head 2 is constituted to eject ink supplied from the ink tank 3 in a form of droplets by utilizing thermal energy. The typical construction and the principle thereof are disclosed in U.S. Pat. No. 4,723,129 and U.S. Pat. No. 4,740,796.

In FIG. 2, the ink tank 3 houses an ink absorbent 3*a* in the entire of the ink storing space, and causes a prescribed negative pressure to the recording head 2 to keep a normal ink ejection state. The ink tank may be in a different construction, provided that the negative pressure can be generated to the recording head 2. For example, the ink tank may have a construction in which the ink occupies the entire of the ink storing space, or a construction in which the ink absorbent material and the ink itself are held in a well-balanced state.

The ink tank 3 is constructed such that air is introduced therein with consumption of the ink by the recording head 2. An air communication part 4 is provided for the introduction of air to prevent an excessive negative pressure and to facilitate the ink supply. FIG. 2 is a sectional view of the air communication part 4 and the vicinity thereof.

In FIG. 2, an air communication part 4 has an opening 4*b*, a plug member 4*a* having a fine hole 4*c*. The opening 4*b* is provided on a case 1*a* constituting the ink-jet cartridge 1. The inside of the ink tank 3 communicates with the outside air through the fine hole 4*c*. The plug member 4*a* comprises a portion to be fitted to the opening 4*b*, and a portion to be handled for attaching and detaching by an operator. The plug member 4*a*, which is made of an elastic material, is tightly fitted to the opening 4*b* in an attached state, so that the ink stored in the ink tank 3 is prevented from leakage of the ink to outside of the ink tank 3.

With such a construction of the air communication part 4, ink can readily be refilled by removing the plug member 4*a* and filling the ink through the opening 4*b* into the inside of the ink tank 3 when the ink has been used up. Therefore, drilling of the ink cartridge case is not necessary, and adverse effect of the shavings on the ink supply is eliminated.

Figure 3:
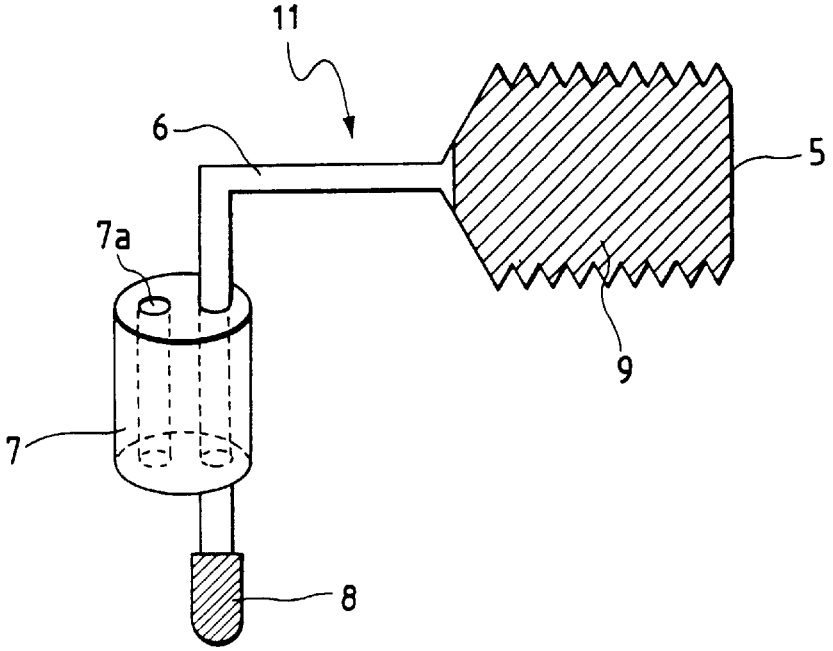
FIG. 3 is a schematic perspective view of an example of an ink-filling device.

FIG. 3 shows an example of construction of an ink-filling device suitable for introducing the ink through the air communication part 4 of the above ink-jet cartridge 1. The ink-filling device 11 has a bellow-shaped ink-holding part 5, a hollow tube 6, and a fitting member 7. The ink-holding part 5 holds the ink 9 to be supplied to the ink tank 3. The hollow tube 6 extends from the supply opening of the ink-holding part 5. The fitting member 7 is provided along the hollow tube 6, and fits to the opening 4*b* of the air communication part of the ink tank 3. The fitting member 7 has a communication path 7*a* for communicating the inside of the ink tank 3 with the outside to allow expelled air to pass during filling of the ink. An air permeable sheet (not shown in the drawing) may be provided to cover the communication path 7*a* to prevent spilling of the ink from the communication path 7*a* when the ink is introduced at a rate higher than the rate of the ink absorption into the ink absorbent.

The communication path 7*a* is not indispensable. In the case where the communication path is not provided, air in the ink tank 3 to be displaced by the filled ink can only be discharged from the discharge opening of the recording head 2. This air discharge can be utilized for recovery of the recording head.

To the ink filling device 11, a cap 8 is attached to protect the tip of the hollow tube 6 during storage.

The ink filling device 11 having the construction as above is preferably made of a biodegradable material which is decomposable in the environment where it is thrown away. For instance, the bellow shaped ink-holding part 5 is made of Bionole (trade name, Showa Highpolymer Co, Ltd.) which is relatively ink-resistant and is transparent to enable visual observation of the stored ink; the hollow tube 6 and the cap 8 are made of Biopol (trade name, Zeneca K.K.) which is superior in moldability; and the fitting member 7 is made of a modified polycaprolactone which is elastic and flexible. The modified polycaprolactone, which is less water-resistant, can satisfactorily be used practically since it is brought into contact with the ink for only a short time.

Figure 4:
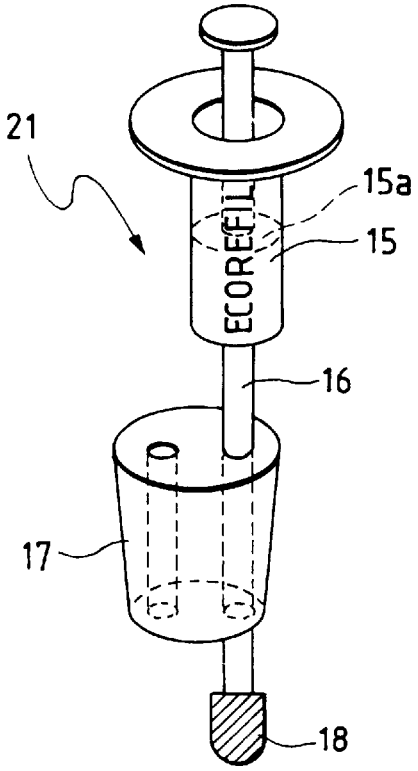
FIG. 4 is a schematic perspective view of another example of an ink-filling device.

FIG. 4 shows another example of construction of the ink-filling device 21. This device has a syringe type of ink-holding part 15 with a plunger 15*a* which is different from the construction of the ink-filling device 11 in FIG. 3. The ink-filling device 21, similarly as the one of FIG. 3, has a hollow tube 16 extending from the supply opening of the ink-holding part 15; a fitting member 17 which is provided along the hollow tube 16 and is to be fitted to the opening 4*b* of the air communication part 4 of the ink tank 3; and a cap 18 for protecting the tip of the hollow tube 16. The syringe type of ink-holding part 15 can be molded integrally with the hollow tube 16 from Biopol (trade name, Zeneca K.K.) which has excellent moldability. Such a syringe type ink-filling device 21 enables filling of ink at a higher pressure, thus shortening the filling operation time.

The ink-filling device is not limited to those of the type described above, and may be ones utilizing gravitational down flow of the ink to fill the ink into the ink tank 3.

The ink-filling devices 11, 21 constructed from such a biodegradable material has preferably an ink-resistant layer for protecting the ink-contacting area in order to improve the ink resistance of the device. The materials of the ink-resistant layer is selected from the materials which are capable of improving the ink-resistance without impairing the properties of the biodegradable material and has high moldability.

The material for the ink-resistant layer is required to have sufficient ink resistance and sufficient gas barrier properties, and not to cause environmental pollution. The ink-resistant layer is preferably formed by PVD such as sputtering, vacuum deposition, and ion plating. More preferably the ink-resistant layer is formed by low temperature plasma CVD which is less liable to give adverse effect to the biodegradable material in the film formation. The suitable material includes $SiO_x$ (x=1.7 to 1.8), $SiN_y$, and alumina. In view of the mechanical strength, the $SiO_x$ layer or the $SiN_y$ layer is formed in a thickness of preferably from 4 to 7 $\mu$m, and the alumina in a thickness of preferably from 60 to 150 nm. This working for ink-resistance broadens the scope of selection of the applicable biodegradable material, and makes easier the selection of the material for the device. Thereby, even a biodegradable material having less ink-resistance can be employed for the device to lower the material cost and the product price.

With the above-described ink-filling device, ink is filled into an ink tank 3 by the procedures below. Firstly, the plug member 4*a* is detached manually from the air communication part 4 of the ink cartridge 1 having the ink tank 3 to be filled with ink. The cap 8 (18) is removed from the tip of the hollow tube 6 (16) of the ink-filling device 11 (21). The tip of the hollow tube 6 (16) is inserted into the ink tank 3 through the opening 4*b* exposed by detaching the plug member 4*a*. Further the fitting member 7 (17) of the ink filling device 11 (21) is fitted to the opening 4*b*. In this state, the ink-holding part 5 (15) is pressed to fill the ink from the ink filling device 11 (21) into the ink tank 3. After completion of ink filling, the ink filling device 11 (21) is removed, and the plug member 4*a* is fitted again to the opening 4*b*. Thereby the ink filling operation is completed. The ink cartridge refilled with the ink is mounted onto the recording apparatus to continue recording.

The amount of the ink to be held in the ink-holding part 5 (15) of the ink filling device 11 (21) may be equal to the ink storing capacity of the ink tank 3. Otherwise the amount may be equal to integer number times the storing capacity, and marks for one-filling volume may be shown visually on the ink-holding part 5 (15).

With the construction of the ink tank and the ink-filling device, the ink filling can be conducted simply with high reliability without hole drilling of the ink tank and formation of shavings.

The ink-filling device can be fitted surely to the large-diameter opening of the ink tank by use of the fitting member provided along the hollow tube for ink injection to the ink tank. Thereby the ink can be filled quickly and safely with the opening surely fitted to the ink-filling device without leakage of ink from the opening.

What is claimed is:

1. An ink-filling device for filling ink to an ink tank through an injection opening of an ink tank for storing ink to be supplied to a recording head, the ink filling device comprising an ink-holding part for holding ink to be refilled, a pressurizing member for pressurizing the ink-holding part, a hollow tube extending from the ink-holding part, and a fitting member provided along the hollow tube for fitting into the injection opening, the fitting member having an air hole to communicate the interior of the ink tank with the outside when the fitting member is fitted into the injection opening, wherein the ink-filling device is constructed from a biodegradable material, and wherein the ink-filling device has an interior surface in contact with ink and the interior surface is treated with a material for ink resistance, the material being selected from $SiO_x$, $SiN_y$ and alumina.

2. The ink-filling device according to claim 1, wherein a layer of the $SiO_x$ or the $SiN_y$ is formed in a thickness ranging from 4 to 7 $\mu$m.

3. The ink-filling device according to claim 1, wherein a layer of alumina is formed in a thickness ranging from 60 to 150 nm.

4. The ink-filling device according to claim 1, wherein a gas permeation membrane is provided at the air hole.

* * * * *